United States Patent [19]

Cadle

[11] 4,138,760

[45] Feb. 13, 1979

[54] CARPET CLEANING ATTACHMENT

[76] Inventor: Michael D. Cadle, 150 Mitchell Blvd., San Rafael, Calif. 94903

[21] Appl. No.: 866,050

[22] Filed: Dec. 30, 1977

[51] Int. Cl.[2] ..... A47L 7/00

[52] U.S. Cl. ..... 15/321; 15/328

[58] Field of Search ..... 15/246, 320, 321, 328, 15/339, 353; 8/158

[56] References Cited

U.S. PATENT DOCUMENTS

| | | | |
|---|---|---|---|
| 1,268,962 | 6/1918 | Gray | 15/320 X |
| 1,498,255 | 6/1924 | Winchester | 15/320 |
| 2,635,278 | 4/1953 | Belknap | 15/320 X |
| 3,909,197 | 9/1975 | Cremers | 8/158 |
| 4,009,728 | 3/1977 | Parise | 15/321 X |

*Primary Examiner*—Philip R. Coe
*Attorney, Agent, or Firm*—Melvin R. Stidham

[57] ABSTRACT

A carpet washing attachment for a tank-type, wet - dry vacuum cleaner comprising a fluid tank in a form of a hollow collar of a size and shape to fit around the vacuum tank and being supported on the top and depending along the sides thereof. A pump in the tank delivers a washing solution through a duct which extends along the vacuum hose and wand to terminate in a nozzle adjacent the suction head. A quick disconnect coupling at the fluid tank enables the washing attachment to be inactivated, and another at the connection between the vacuum hose and the wand enables a quick change to a shorter wand for cleaning upholstery.

6 Claims, 6 Drawing Figures

CARPET CLEANING ATTACHMENT

BACKGROUND OF THE INVENTION

As far as is known, there are no attachments for commercial or domestic type vacuum cleaners which enable one to wash the carpet by use of a liquid solution. Most families cannot justify the purchase of a carpet washing machine for the occasions in which it is used, and for the most part, the homemaker is required to turn to professional cleaners or to rent carpet washing machines which may be available at a supermarket, hardware store or other retail outlets, usually to promote the sale of the carpet cleaning solution. This, of course, requires at least two trips to the store, to rent the machines and to return it, but for most it is the more feasible alternative to purchase of the relatively expensive machines.

OBJECTS OF THE INVENTION

It is an object of this invention to provide a carpet washing attachment for a conventional tank-type, wet-dry vacuum cleaner.

It is a further object of this invention to provide a carpet washing attachment which is inexpensive.

It is a further object of this invention to provide a carpet cleaning attachment which is simple to activate and operate.

It is a further object of this invention to provide a carpet cleaning attachment which is efficient and thorough in operation.

Other objects and advantages of this invention will become apparent from the description to follow, particularly when read in conjunction with the accompanying drawings.

BRIEF SUMMARY OF THE INVENTION

In carrying out this invention, I provide a tank for a hot liquid soap solution or the like which is in the form of a hollow collar having an inner periphery which is supported on the upper surface of the vacuum tank of a wet-dry vacuum by gravity and which depends along and fits around the upright sides of the tank. With the collar tank surrounding the vacuum tank the center of gravity of the vacuum tank is not displaced laterally and, since it fits around, and not on top of, the vacuum tank the center of gravity is maintained at a relatively low level for considerable stability. A pump is disposed in the fluid tank collar and a duct extending from the tank is clipped along the vacuum hose and the wand connected thereto to terminate in a spray nozzle disposed adjacent the suction head on the end of the wand whereby a spray of the liquid solution projected on the carpet immediately followed by the suction head to suck it up. A quick disconnect coupling at the tank has a check valve which automatically prevents flow from the tank when the duct is removed and another quick disconnect coupling at the connection between the vacuum hose and the wand enables the replacement of wands, as for upholstery cleaning.

DESCRIPTION OF PREFERRED EMBODIMENTS

The Embodiment of FIGS. 1 to 5.

Figures 3, 4, 5:
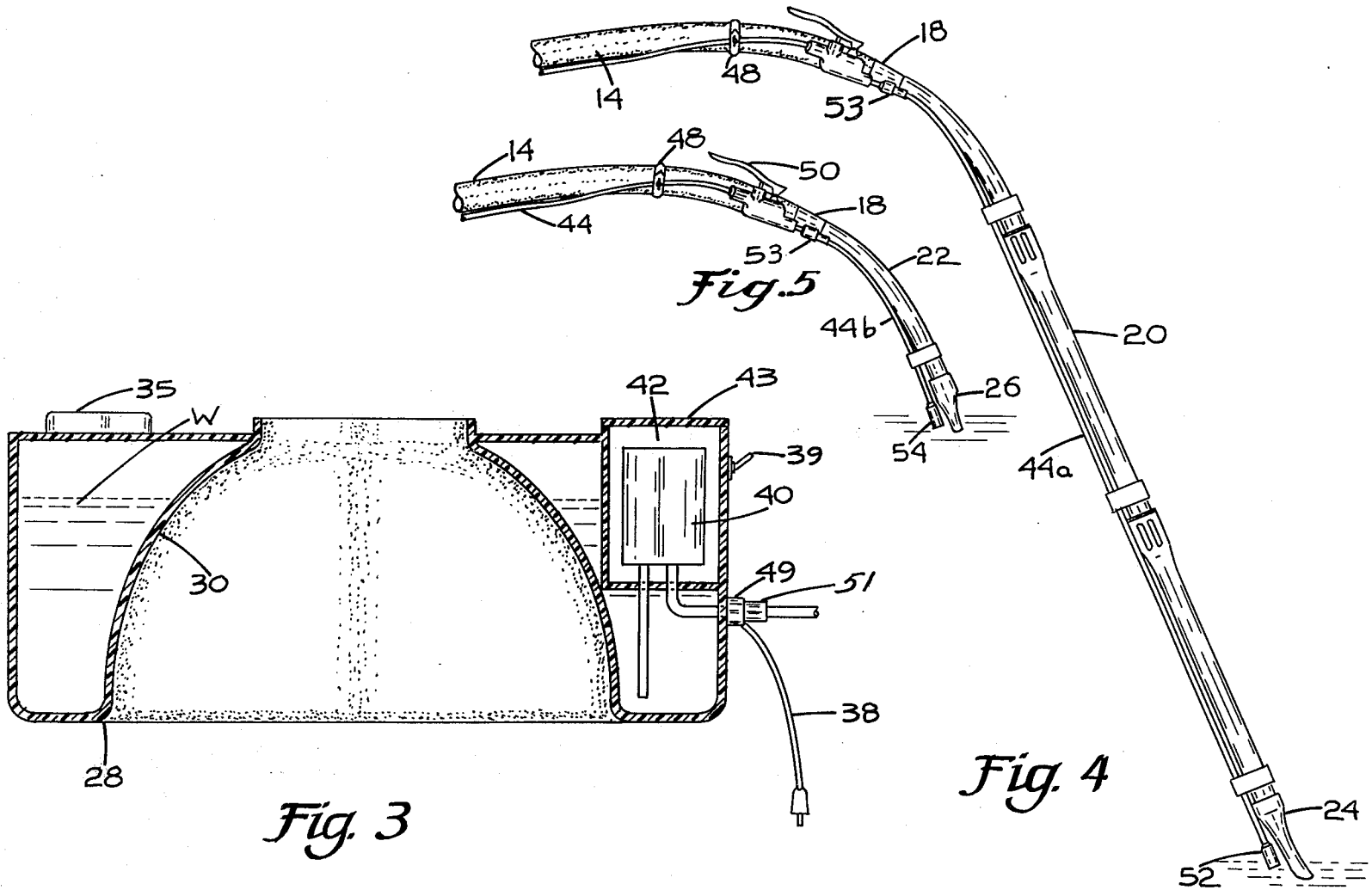
FIG. 3 is a section view of the carpet cleaning attachment.
FIGS. 4 and 5 are partial elevation views of the duct and spray nozzle for carpet and upholstery cleaning respectively.

Referring now to the drawings with greater particularity, the carpet cleaning attachment 10 of this invention is shown mounted on the tank 12 of a conventional tank-type vacuum cleaner, particularly of the wet-dry type, including a vacuum hose 14 and a handle 16 for portability. As shown in FIGS. 4 and 5 the end 18 of the vacuum hose 14 is adapted to receive for connection thereon one or more sections of wands 20 and 22, each carrying at its distal end appropriate suction fitting 24 and 26 for cleaning the carpet or upholstered furniture, respectively.

Figure 1:
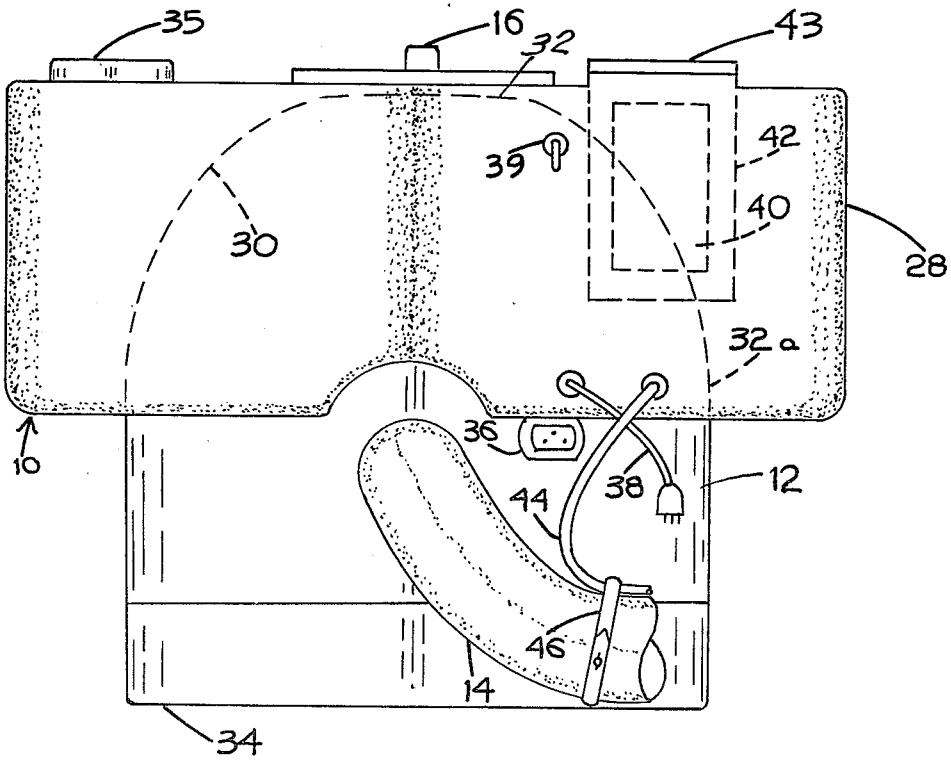
FIG. 1 is an elevation view of the carpet washing attachment of this invention mounted on a tank-type vaccum cleaner.
Figure 2:
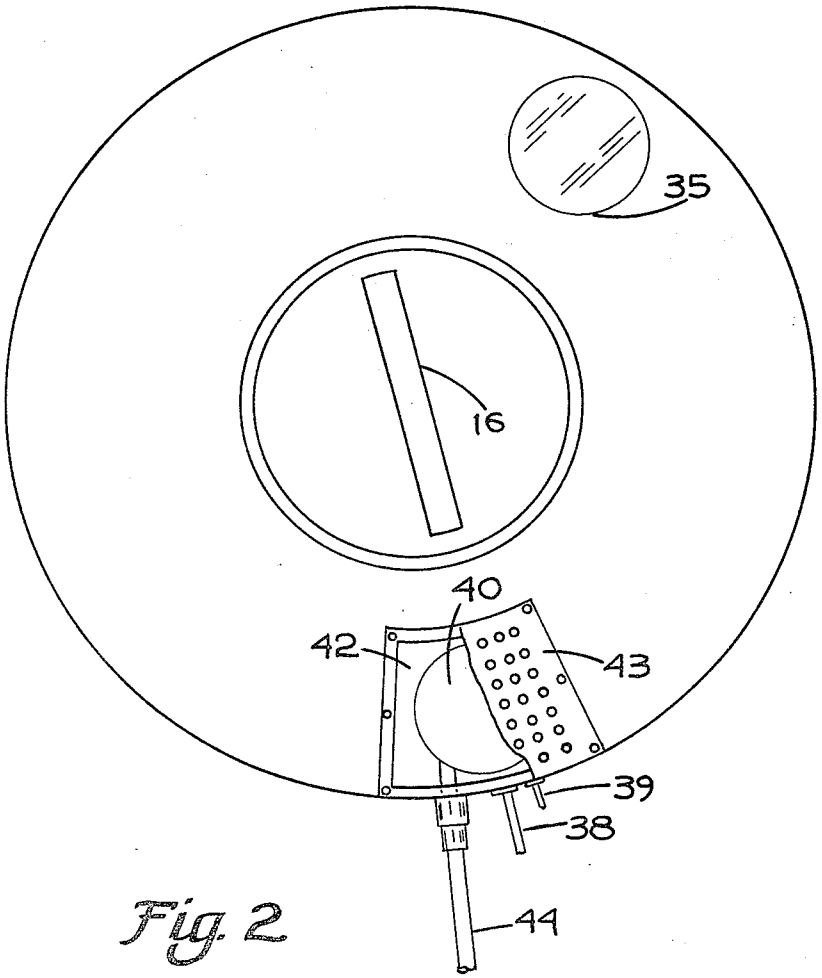
FIG. 2 is a top view of the carpet cleaning attachment.

As shown particularly in FIGS. 1 and 3, the carpet washing attachment 10 includes a collar-like tank 28, which fits around the vacuum tank 12 and has an inner periphery 30 which is adapted to engage the upper surface 32 of the vacuum tank and depend along the upright sides **32*a* thereof. Hence, the fluid tank 28 may be carried on the vacuum tank 12 solely by gravity without fastening means. In addition, because the collar tank 28 completely surrounds the vacuum tank 12, there is no tendency to shift laterally or offset the center of gravity whereby it remains well within the base 34 of the wet vacuum receiving tank 12*a*. Further, because the tank collar 28 fits around the vacuum tank, and does not extend above it, it provides a relatively low center of gravity particularly with a liquid solution W carried therein, same being introduced upon removal of filler cap 35**.

The vacuum tank 12 is provided with an electric outlet 36 into which may be plugged an electric conductor 38 which upon engagement of a switch 39 energizes a small electric pump 40 carried in a pump well 42 in the interior of the liquid tank 28. The pump well cover is perforated as shown for ventilation.

The pump 40 projects the liquid solution from the tank collar 28 through a duct 44 which is strapped or clipped, as at 46, 48 along the length of the vacuum hose 14, terminating in a hand controlled valve 50 at the end of the vacuum hose 14. A quick disconnect coupling 56 at the outlet of the pump 40 has a check valve 49 on the pump delivery side whereby when disconnected, the valve 49 closes immediately. Another quick disconnect coupling 53 is provided in the duct 44 at the end 18 of the vacuum hose 44 whereby the liquid delivery sections **44*a* and 44*b* of the ducts may be disconnected with the wands 20 and 22** when converting from carpet to upholstery cleaning.

In operation, the appropriate wands 20 or 22 is secured onto the end of the vacuum hose 14 and at the same time, the quick disconnect coupling is attached for the appropriate fluid delivery duct **44*a* or 44*b* and spray nozzle 52 and 54. Then, when the coupling 51 is made at the pump 40 the switch is turned on to commence delivering a stream of liquid solution through the nozzle 52 or 54 and immediately thereafter the solution with dirt entrained therein is sucked up to the attachment 24 and vacuum hose 14 to the wet vacuum receiving tank 12***a*.

Figure 6:
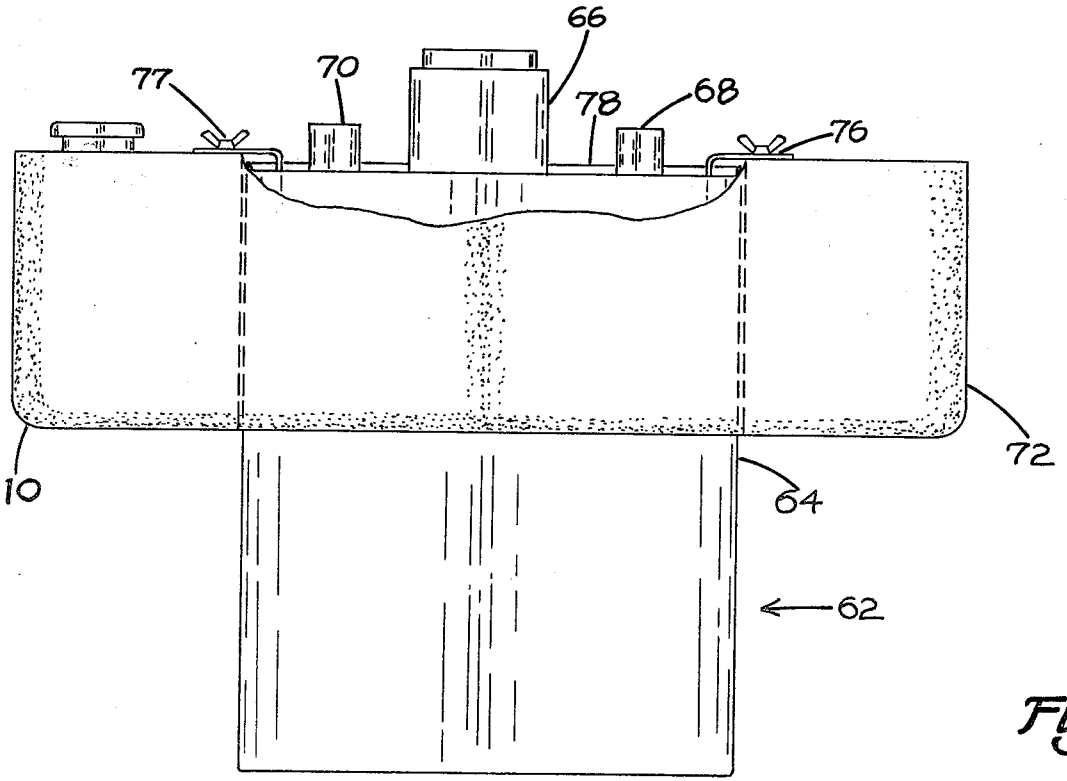
FIG. 6 is an elevation view of another embodiment of this invention.

The Embodiment of FIG. 6

Referring now to FIG. 6 there is shown an embodiment of this invention applied to a conventional wet-dry shop vacuum 62, including a cylindrical tank 64 and a motor driven vacuum pump 66 with vacuum hoses (not shown) adapted to be connected to inlet and outlet flow ports 68 and 70, respectively. The collar tank 27 fits over the cylindrical tank to surround it and adjustable fingers 76 spaced at intervals around the tank may be extended, as by loosening wing nuts 77, to rest against the top 78 of the cylindrical tank 64 to support the tank collar 72.

While this invention has been described in conjunction with preferred embodiments thereof, it is obvious that other modifications and changes therein may be made by those skilled in the art without departing from the spirit of this invention as defined by the claims appended hereto.

Having described my invention I claim:

1. A carpet washing attachment for a tank-type vacuum cleaner comprising:

a vacuum tank enclosure having an upper surface and upright surfaces depending therefrom around the periphery thereof;

a vacuum hose having one end thereof connected to, and opening into, said tank enclosure; and a suction attachment-receiving wand having one end thereof connected to the other end of said hose;

said carpet washing attachment comprising:

a fluid tank of a size and shape to be supported on said vacuum tank upper surface with portions of said fluid tank depending along said upright surfaces of said vacuum tank;

a fluid pump in said fluid tank;

a fluid duct connected to and extending from said pump;

means for securing said fluid duct along said vacuum hose and wand; and a spray nozzle at the end of said fluid duct.

2. The carpet washing attachment defined by claim 1 wherein;

said fluid tank is in the form of a collar of a size to surround said vacuum tank; and including:

portions on said collar for engaging said vacuum tank and support said collar thereon.

3. The carpet washing attachment defined by claim 2 wherein:

said engaging portions are radially adjustable supports on said collar tank for engaging the upper surface of said vacuum tank.

4. The carpet washing attachment defined by claim 1 wherein said securing means are clips for securing said fluid duct to said vacuum hose and wand; and duct coupling means connected in said fluid duct near the connection between said vacuum hose and said wand.

5. The carpet washing attachment defined by claim 4 wherein:

said spray nozzle is disposed adjacent the other end of said wand.

6. The carpet washing attachment defined by claim 1 including:

a manually operated spray control valve in said fluid duct disposed adjacent said other end of said vacuum hose.

* * * * *